US009121186B2

(12) United States Patent
Mensah

(10) Patent No.: US 9,121,186 B2
(45) Date of Patent: Sep. 1, 2015

(54) METHOD AND APPARATUS FOR ENHANCING TRACTION ON STAIR TREADS

(71) Applicant: Brobbey Mensah, Montgomery Village, MD (US)

(72) Inventor: Brobbey Mensah, Montgomery Village, MD (US)

( * ) Notice: Subject to any disclaimer, the term of this patent is extended or adjusted under 35 U.S.C. 154(b) by 0 days.

(21) Appl. No.: 14/260,826

(22) Filed: Apr. 24, 2014

(65) Prior Publication Data

US 2014/0318047 A1 Oct. 30, 2014

Related U.S. Application Data

(60) Provisional application No. 61/816,190, filed on Apr. 26, 2013.

(51) Int. Cl.
*E04F 11/17* (2006.01)
*E04F 11/16* (2006.01)

(52) U.S. Cl.
CPC ..... *E04F 11/17* (2013.01); *E04F 11/166* (2013.01); *Y10T 29/49826* (2015.01); *Y10T 29/49963* (2015.01); *Y10T 428/24008* (2015.01); *Y10T 428/24331* (2015.01)

(58) Field of Classification Search
CPC ..... E04F 11/16; E04F 11/17; E04F 11/163; E04F 11/166; E04F 11/175
USPC ..... 52/179, 181, 182, 188
See application file for complete search history.

(56) References Cited

U.S. PATENT DOCUMENTS 334,994 A 1/1886 Spadone
442,256 A * 12/1890 Nash ..... 52/179
973,346 A * 10/1910 Davis ..... 52/179
1,177,402 A 3/1916 Engemann
1,667,040 A 4/1923 Larkin
1,458,708 A 6/1923 Jeppson
1,497,163 A * 6/1924 Van Der Pyl ..... 52/179
1,611,211 A * 12/1926 Loehr ..... 52/179
1,675,198 A * 6/1928 Scott ..... 52/179
1,681,073 A * 8/1928 Welcome ..... 52/179
1,738,775 A * 12/1929 Jacques ..... 52/177
2,106,399 A * 1/1938 Beaumont et al. ..... 52/177
2,288,470 A * 6/1942 Lorraine ..... 52/179
2,787,036 A 4/1957 Mermer (Continued)

OTHER PUBLICATIONS

International Search Report and the Written Opinion, PCT/US2014/035267, Aug. 18, 2014, 8 pages.

*Primary Examiner* — Brian Glessner
*Assistant Examiner* — Adam Barlow
(74) *Attorney, Agent, or Firm* — Edell, Shapiro & Finnan, LLC

(57) ABSTRACT

A traction element for carpeted stair treads or other flooring includes a deformable substrate secured by screws to the tread that is vertically aligned with the top edge of a riser and slightly rearward of the tread leading edge. The substrate is covered with adhesive backed friction tape. The screws extend through respective apertures centered in respective concave tapered annular recesses defined in the substrate. The apertures are in a linear array defining a bend axis along the substrate length and the tread width and about which the substrate deforms as it is being threadedly attached to the tread. When thusly bent the substrate top surface becomes concave such that its forward edge is higher than its rearward edge, thereby establishing a slight forwardly extending incline. The tape strip conforms to the bent substrate and its exposed top surface comprises a high friction or abrasive substance.

22 Claims, 10 Drawing Sheets

(56) References Cited

U.S. PATENT DOCUMENTS

| | | | | | |
|---|---|---|---|---|---|
| 2,835,937 | A | * | 5/1958 | Hobbs | 52/179 |
| 3,421,274 | A | * | 1/1969 | Reiff et al. | 52/179 |
| 3,759,000 | A | * | 9/1973 | Balzer et al. | 52/179 |
| 3,801,424 | A | | 4/1974 | Robbins, Jr. | |
| 3,980,364 | A | | 9/1976 | Entrikin et al. | |
| 4,001,991 | A | * | 1/1977 | Balzer et al. | 52/179 |
| 4,037,374 | A | * | 7/1977 | Balzer et al. | 52/179 |
| 4,058,942 | A | * | 11/1977 | Naka | 52/179 |
| 4,060,947 | A | * | 12/1977 | Naka | 52/179 |
| 4,077,825 | A | * | 3/1978 | Naka | 156/244.18 |
| 4,112,641 | A | * | 9/1978 | Balzer | 52/179 |
| 4,151,320 | A | * | 4/1979 | Naka | 428/163 |
| 4,285,177 | A | * | 8/1981 | Seegers | 52/179 |
| 4,318,951 | A | * | 3/1982 | Naka et al. | 428/167 |
| 4,321,293 | A | | 3/1982 | Naka | |
| 4,879,151 | A | | 11/1989 | Ellingson, Jr. | |
| 4,900,606 | A | | 2/1990 | Sakaki | |
| 4,985,095 | A | | 1/1991 | Riddle | |
| 4,998,391 | A | * | 3/1991 | Connew | 52/179 |
| 5,103,608 | A | * | 4/1992 | Andreo | 52/179 |
| 5,461,836 | A | * | 10/1995 | Yang | 52/179 |
| 5,645,912 | A | * | 7/1997 | Nelson et al. | 428/67 |
| 5,778,609 | A | | 7/1998 | Pawson et al. | |
| 6,101,770 | A | * | 8/2000 | Dalton | 52/179 |
| D447,249 | S | | 8/2001 | Chang et al. | |
| 6,427,395 | B1 | * | 8/2002 | Elsasser et al. | 52/181 |
| 6,632,506 | B1 | * | 10/2003 | Grall | 428/141 |
| D593,785 | S | | 6/2009 | Preda | |
| D594,564 | S | | 6/2009 | Disch et al. | |
| D595,079 | S | | 6/2009 | Preda | |
| 7,789,235 | B2 | | 9/2010 | Trapp et al. | |
| D654,295 | S | | 2/2012 | Preda | |
| D655,554 | S | * | 3/2012 | Preda | D6/582 |
| D668,689 | S | | 10/2012 | Bang | |
| D668,690 | S | | 10/2012 | Bang | |
| 8,534,009 | B2 | | 9/2013 | Kay | |
| 2002/0066242 | A1 | | 6/2002 | Hsu | |
| 2003/0101665 | A1 | | 6/2003 | Preda | |
| 2006/0156650 | A1 | | 7/2006 | Sondermann | |
| 2008/0020166 | A1 | | 1/2008 | Esposito et al. | |
| 2008/0035687 | A1 | | 2/2008 | Beaulieu | |
| 2009/0145059 | A1 | | 6/2009 | Kay | |
| 2010/0083592 | A1 | * | 4/2010 | Muehlebach | 52/179 |
| 2012/0000151 | A1 | * | 1/2012 | Cromb | 52/179 |

* cited by examiner

METHOD AND APPARATUS FOR ENHANCING TRACTION ON STAIR TREADS

CROSS REFERENCE TO RELATED APPLICATIONS

This application is a non-provisional application based on U.S. Provisional Application No. 61/816,190, entitled "Non-Slip Strip for Carpeted Surfaces, Particularly Stairs", filed Apr. 26, 2013, the entire disclosure of which is hereby incorporated by reference.

BACKGROUND

1. Technical Field

The present invention primarily pertains to traction elements applied to carpeted stair treads, and the like, to prevent persons from slipping on the stair treads, and, in addition, the invention pertains to methods of making and applying the traction elements to carpeted stair treads and other surfaces.

2. Terminology

It is to be understood that, unless otherwise stated or contextually evident, as used herein: the terms "upper", "top", "lower", "bottom", "vertical", "horizontal", etc., are used for convenience to refer to the orientation of slip prevention structure when installed on a stairway with horizontal treads and vertical risers and are not intended to otherwise limit the structures described and claimed; the terms "axis", "axially", "longitudinal", "longitudinally", etc., refer to dimensions extending parallel to the length dimension of the aforesaid structure; and the terms "lateral", "laterally", transverse, etc., refer to the width dimensions of the aforesaid structure. When used to describe a stair tread surface, the term "width" refers to the tread surface dimension oriented transversely of the direction of stairway ascent and descent, and the term "depth" refers to the dimension in the direction of such ascent/descent. When used to describe a substrate employed in the invention, the term "length" refers to the longest dimension of the substrate along its top and bottom surfaces, the term "width" refers to the dimension perpendicular to the substrate length along those surfaces, and the term "thickness" refers to the distance between those surfaces.

3. Discussion of the Prior Art

Carpeted stair treads, particularly at their forward or leading edges, tend to wear with use, resulting in a relatively low friction surface on which persons slip and injure themselves. The prior art includes many attempts to solve this problem, most of which suffer from one or more disadvantages such as expense, complexity and/or time consumption in installation, poor aesthetic appearance, ineffectiveness in providing sufficient friction, etc.

OBJECTS AND SUMMARY OF THE INVENTION

Therefore, it is one object of the present invention to provide an improved structure for enhancing friction on a carpeted stair tread. It is another object of the invention to provide such structure that is inexpensive, easily and quickly installed, aesthetically adaptable to its installation site and reliable in providing the desired friction.

A further object of the invention is to provide an efficient method for installing a friction-providing structure on carpeted stair treads.

Another object of the invention is to provide a kit of components that can be assembled to provide a unique traction element for use on flooring.

A still further object of the invention is to provide a unique traction element for use on flooring.

The aforesaid objects are achieved individually and in combination, and it is not intended that the present invention be construed as requiring two or more of the objects to be combined unless expressly required by the claims attached hereto.

With the foregoing objects in mind, in accordance with one aspect of the present invention a kit sold to consumers for assembling traction elements to enhance traction on carpeted stairs or other flooring surfaces includes a plurality of long narrow support substrates of solid deformable metal or plastic material, each support substrate having a thickness dimension that, in conjunction with the substrate material, is sufficiently small to permit bending deformation about a longitudinal bending axis the substrate. Each substrate has a linear array of longitudinally spaced screw-receiving apertures defined therethrough, the array defining the bending axis and extending parallel to the long forward and rearward substrate edges, closer to the rearward edge. The apertures are all centered in respective concave tapered annular recesses defined in the top surface and forming respective convex protrusions in the bottom surface. Friction tape strips have a bottom surface coated with an adhesive material capable of adhering and conforming to the support substrates, and a top surface comprising an abrasive substance having a much higher coefficient of friction than that of the support substrate. The adhesive material is covered with a peel-off protective backing strip for protection during transportation and storage. The friction tape has a width dimension substantially equal to or slightly greater than the width dimension of the support substrates, and is configured to overlie, cover, and conform to the top surface of the support substrates, and have its bottom surface adhere to those top surfaces.

Multiple screws are provided, each having a head diameter larger than the diameter of the screw-receiving apertures, the head being configured to be disposed entirely in the recess below the plane top surface of the support substrate when the screw is extended lengthwise entirely through one of the apertures. In this manner the screw heads are below the bottom surface of the friction tape strip and do not contact or raise the tape strips so as to uncomfortably project against the sole of a person standing or stepping on the traction element.

When installed on horizontal treads of a stairway connected between successive vertical risers, each support substrate is secured through the tread to the top edge of an underneath riser by the screws extending entirely through respective screw receiving apertures, through the tread and into the riser top edge to compress carpet material between the substrate and tread and cause the top surface of the substrate to bend into a concave configuration about its bending axis. When installed on other flooring surfaces such as wood, each support substrate is secured to the flooring by screws extending into the flooring or, in the case of concrete, by adhesive or other appropriate means which may involve providing a shallow recess for the traction element for receiving the substrate.

Another aspect of the invention includes a system for resisting slippage between a person's shoe outsole and carpeted stair treads and comprises the components of the aforesaid kit installed on the stair treads.

Another aspect of the invention includes a method of preventing slippage between an outsole of a person's shoe and a carpeted stairway or other flooring. The method includes installing friction tape strips on each stair tread or other flooring at a linear location which, on a stair tread, is spaced rearwardly from the forward tread edge and directly above the top edge of the preceding riser, and providing the friction tape strip with a desired color by: providing visual evidence such as a photo or swatch of the desired color for the friction tape strips; printing a photo of the evidence on adhesive-backed waterproof vinyl material; laminating the print with transparent or translucent friction material; and cutting the laminated material into strips.

The features described in combination above may also be used independently.

The above and still further features and advantages of the present invention will become apparent upon consideration of the definitions, descriptions and descriptive figures of specific embodiments thereof set forth herein. In the detailed description below, like reference numerals in the various figures are utilized to designate like components and elements, and like terms are used to refer to similar or corresponding elements in the several embodiments. While these descriptions go into specific details of the invention, it should be understood that variations may and do exist and would be apparent to those skilled in the art in view of the following description.

DESCRIPTION OF THE PREFERRED EMBODIMENTS

Specific dimensions set forth below are by way of example for particular embodiments to assist in an understanding of the illustrated structure; these dimensions are not to be construed as limiting the scope of the invention unless otherwise stated.

Figure 1:
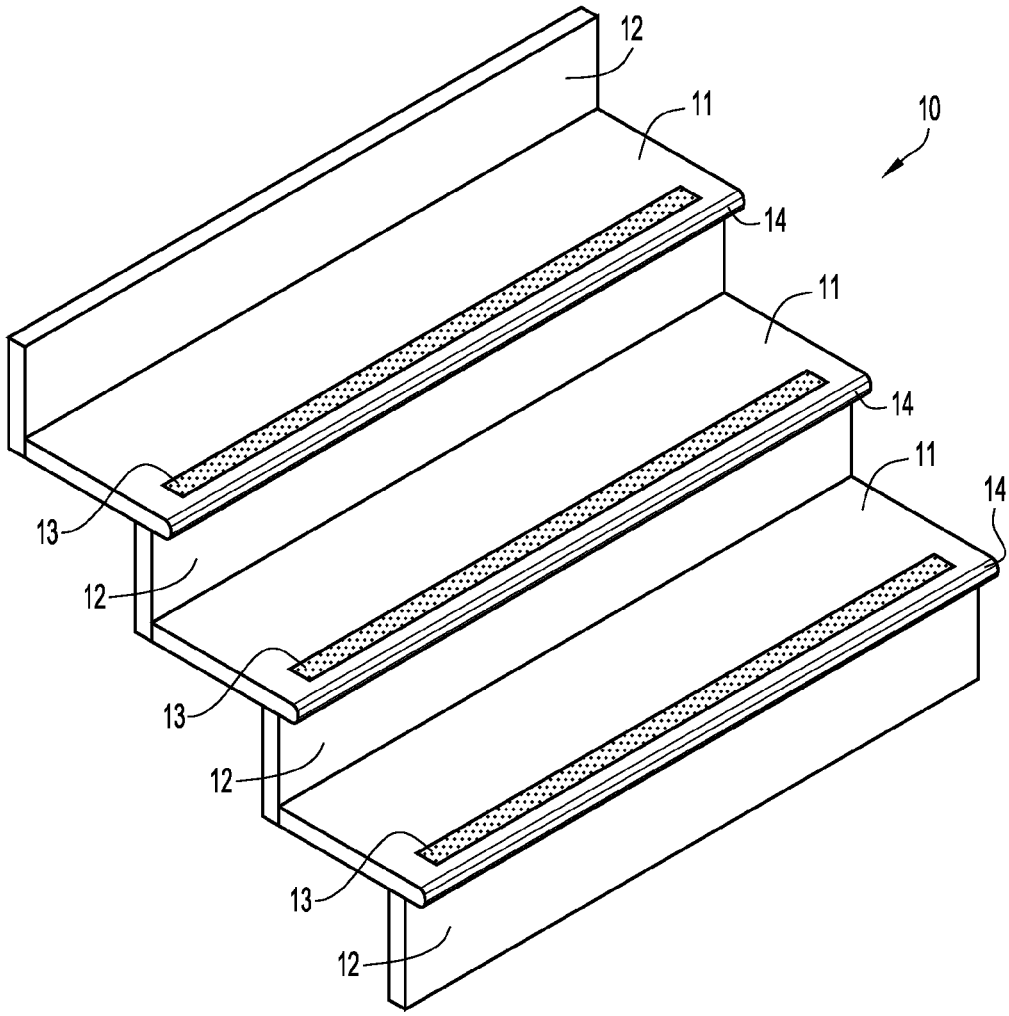
FIG. 1 is a perspective view of a carpeted stairway provided with traction elements in accordance with the present invention.

Referring specifically to FIG. 1, a stairway 10 is shown diagrammatically as comprising a series of horizontal stair treads 11 serially connected via a plurality of vertical risers 12. Specifically, a forward portion of each tread 11 is supported on and secured to an upper edge of a riser 12. As shown, the stairway is constructed with the forward or leading edge 14 of each tread overhanging (i.e., extending forwardly of) the riser on which that tread is supported; however, it is to be understood that for some stairways the leading edge of the treads may be flush or coplanar with the supporting riser and that the invention, as described below, also has applicability for such a stairway. On each tread 11 there is secured a traction element 13 configured as an elongate generally rectangular element with its length dimension oriented parallel to the leading edge of the tread. Traction element 13 extends lengthwise along most if not all of the tread width so as to assure that it will be stepped on by a person ascending or descending the stairway. Importantly, the forward edge of traction element 13 is disposed slightly rearward of the tread leading edge 14. Also importantly, the traction element is at least partially aligned vertically with the upper edge of the riser 12 supporting the leading edge of tread 11 on which the traction element is supported so that it may be secured to that riser through the tread in the manner described hereinbelow.

Figure 2:
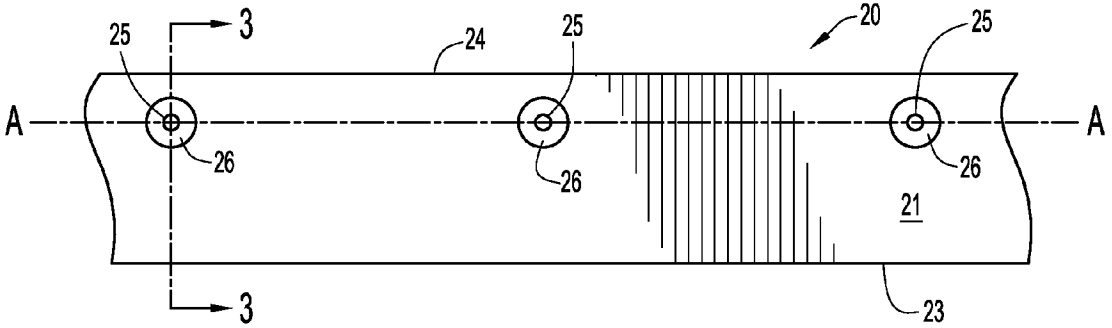
FIG. 2. is a top view in plan of a support substrate component of the traction elements of FIG. 1.
Figure 3:
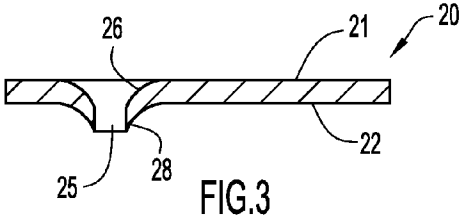
FIG. 3 is a transverse elevation view in section of a support substrate taken along lines 3-3 of FIG. 2.
Figure 4:
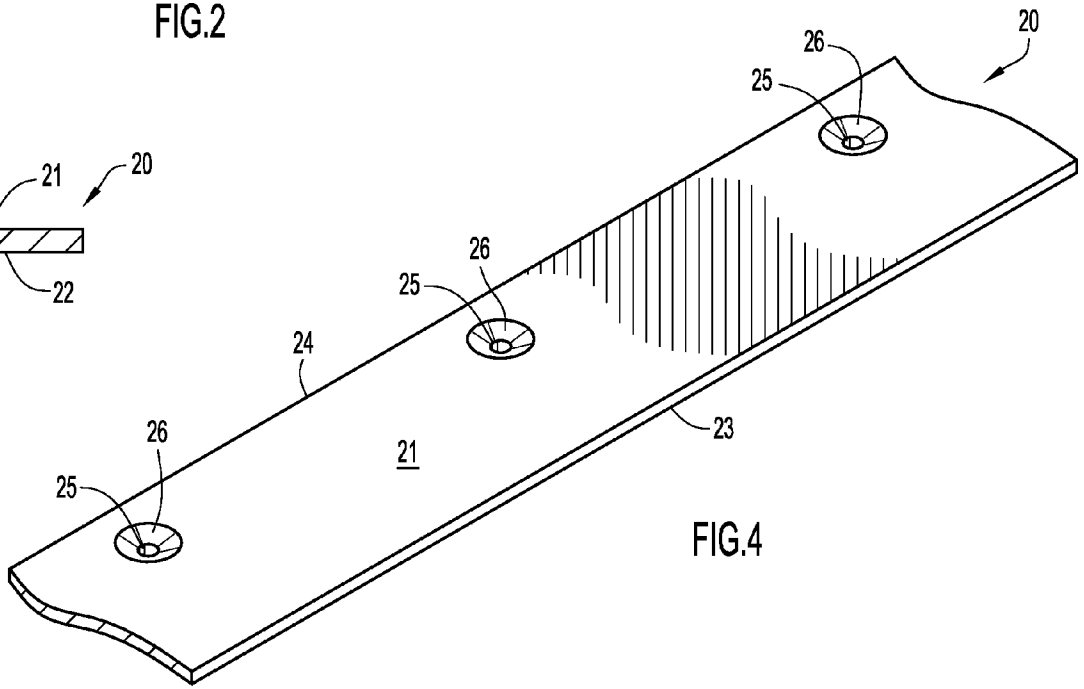
FIG. 4 is a top view in perspective of the support substrate of FIG. 2.

Traction element 13 comprises two primary components; a support substrate 20 illustrated in FIGS. 2-4, and a friction tape strip 30 described hereinbelow. Referring to FIGS. 2-4, support substrate 20 is a long narrow support rectangular sheet of solid deformable metal or plastic material having a top surface 21, a bottom surface 22, long mutually parallel forward edge 23 and rearward edge 24, and first and second ends (not shown in FIGS. 2-4) defining the substrate length dimension therebetween. The substrate length dimension is typically, but not necessarily, dependent on the width of the tread 11 on which it is placed, where the tread width is taken transversely of the direction of travel on the stairway 10. For most applications the substrate length should be in a range from 80% to 100% of the tread width and most preferably in a range between 90% and 97% of the tread width. The width dimension of substrate 20 is defined between the long forward and rearward edges 23 and 24, respectively, and is much smaller than the length dimension. The substrate width is typically in a range between 1½ and 2½ inches, and preferably is approximately two inches. The thickness of substrate 20 is defined between top surface 21 and bottom surface 22 and is very much smaller than the width dimension, typically in the range of 0.02 inch and 0.06 inch, the preferred thickness being approximately 0.04 inch.

Circular screw-receiving through holes or apertures 25 are defined through the thickness dimension of substrate 20 and are arranged in a linear array defining an axis A-A oriented parallel to edges 23 and 24. Axis A-A passes through the geometric centers of apertures 25 and is located closer to rearward edge 24 than to forward edge 23. Specifically, axis A-A is located approximately three-quarters of the distance from forward edge 23 to rearward edge 24 which, in one preferred embodiment, is approximately 1½ inches from forward edge 23. Each aperture 26 is centrally located within a respective concave annular recess 26 in top surface 21 which is typically punched through that surface so that the recess arcuately tapers downwardly and forms a convex annular protrusion 28 extending from bottom surface 22. Apertures 25 are preferably spaced equally along the array which extends over substantially all of the substrate length. The spacing between successive screw-receiving apertures 25 may be chosen as necessary to effectively secure the substrate to a stair tread as described below; in a preferred embodiment this spacing is approximately 2½ inches between aperture centers.

Substrate 20 is made from a solid deformable metal or plastic material which, in the preferred embodiment is aluminum. The nature of the material and the thickness of the substrate are such that the substrate can be bent when subjected to appropriate forces, particularly about bending axis A-A.

Figure 5:
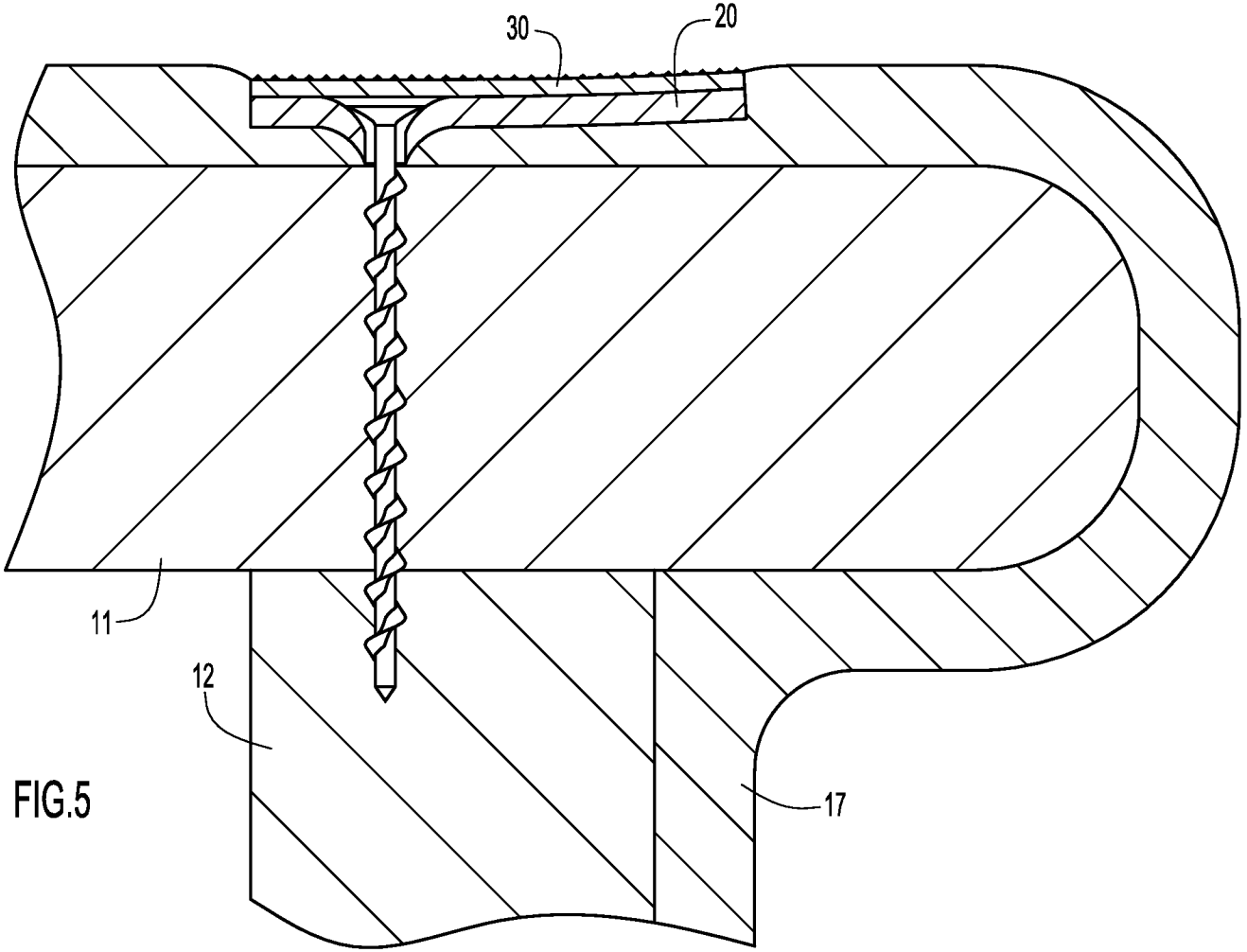
FIG. 5 is an elevation view in section of a traction element according to the present invention installed on a stair tread and riser according to the present invention.
Figure 6:
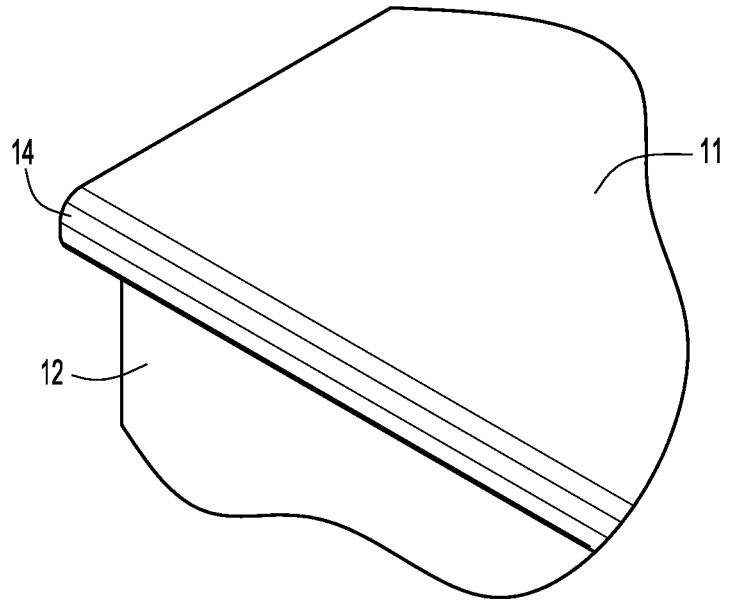
FIG. 6 is a partial view in perspective showing a stair tread and riser prior to installation of a traction element of the present invention.
Figure 7:
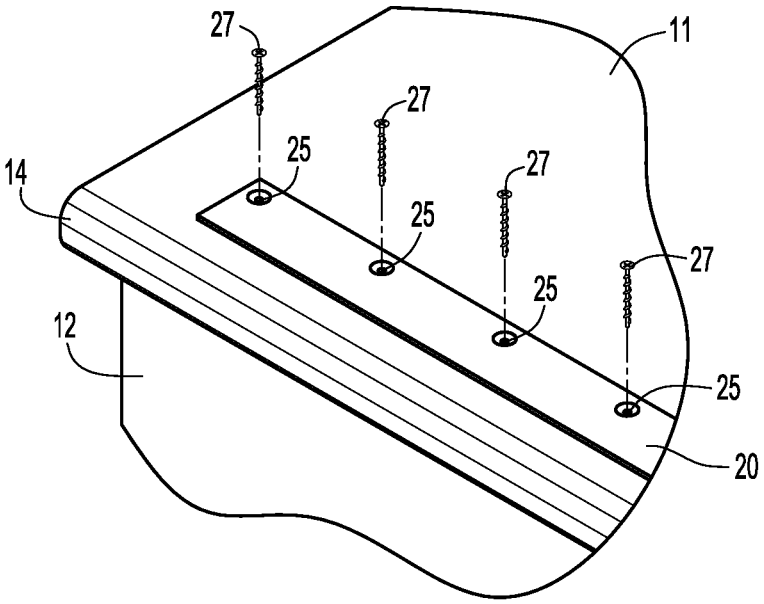
FIG. 7 is an exploded partial view in perspective similar to FIG. 6 showing installation of the substrate portion of the traction element.
Figure 8:
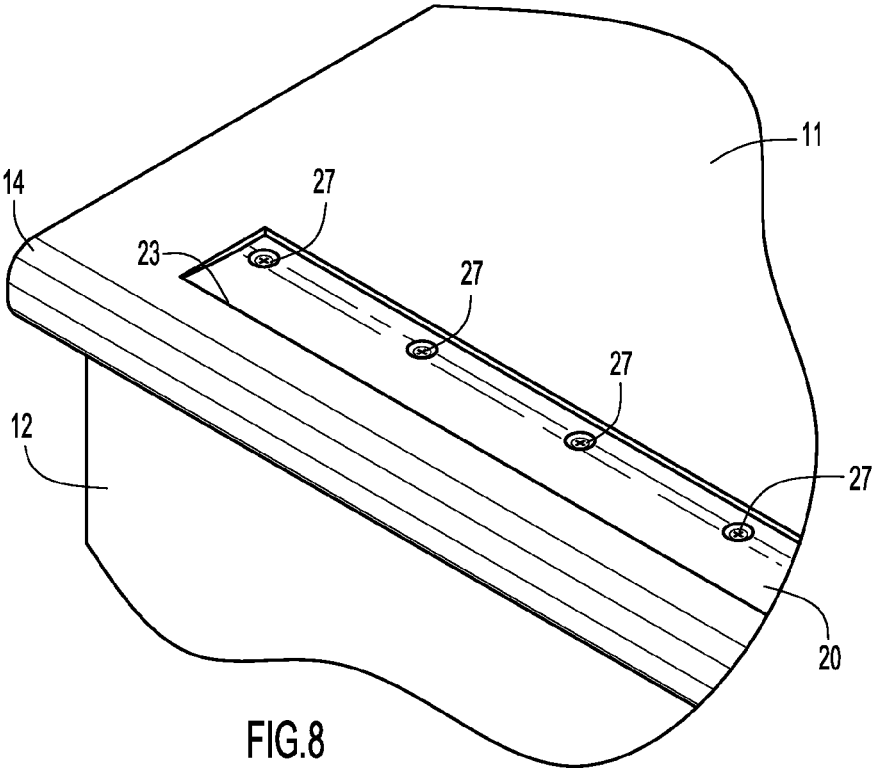
FIG. 8 is a partial view in perspective similar to FIG. 7 showing the substrate portion of the traction element installed.

FIG. 6 illustrates a carpeted stair prior to installation of a traction element 13 of the present invention and includes a tread 11 having a protruding leading edge 14 and supported on the upper edge of a riser 12. FIG. 7 illustrates a substrate 20 being installed on tread 11 by means of screws 27 threadedly driven entirely through respective apertures 25 and tread 11 into riser 12 through its upper edge that underlies the tread and substrate 20. In this regard the substrate is positioned with axis A-A in vertical alignment with riser 12 before the screws are driven through the tread and into the riser. The carpet section between substrate 20 and tread 11 is compressed as the screw driving forces are applied, the compression being the greatest immediately beneath bending axis A-A, where the threaded engagement force is directly applied, and gradually less as a function of distance widthwise of the substrate from that axis. As a consequence, the deformable substrate 20 bends upwardly about the axis, resulting in a concave configuration for exposed top surface 21 and a convex configuration for bottom surface 22. As noted above, axis A-A is not centered widthwise on the substrate but is instead closer to rearward edge 24. Accordingly, there is less downward force exerted by the threaded engagement at the more remote substrate forward edge 23 than at rearward edge 24, with the result that the portion of the substrate forward of the bending axis is not driven downward with as much pressure as the portion rearward of the axis. The result is that the forward edge is at a higher level than the rearward edge, effectively providing a very slight incline or upward slope in the substrate, forwardly of the axis as best seen in FIGS. 5 and 8. This portion of the traction element is typically contacted by the balls of a foot of a person traversing the stairway, and the slight incline provides psychological assurance to the person that he/she in not going to fall or slide downward from the tread.

Figure 11:
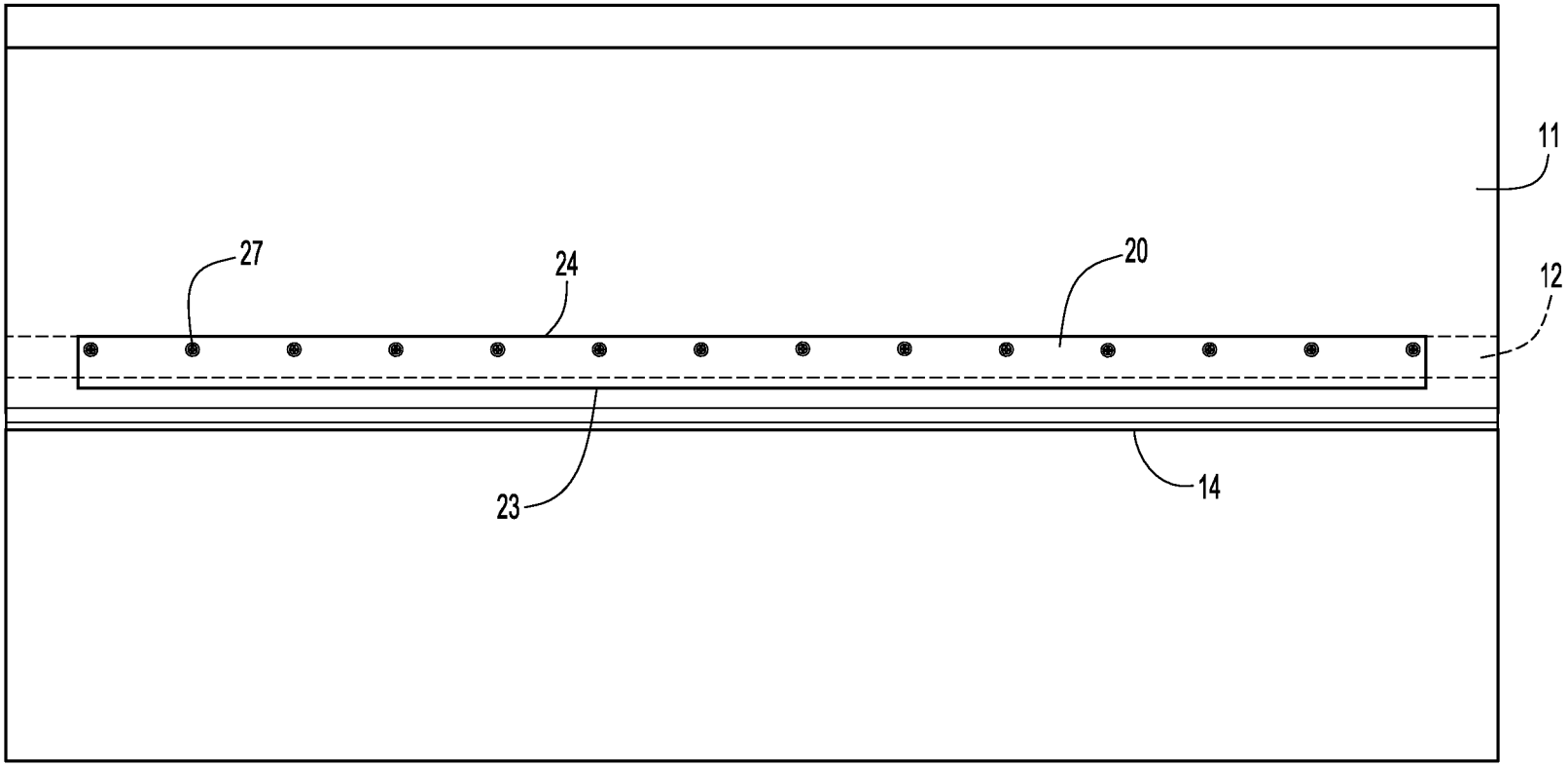
FIG. 11 is a plan view from above showing an installed traction element of the present invention on a stair tread with the edge of a stair riser in phantom.

FIGS. 8 and 11 show the substrate 20 secured to the stair tread 11. It is preferred that the forward edge 23 of the substrate, as shown, be displaced a short distance rearward of the leading edge 14 of the tread, typically by about 1½ inches, and this is true whether the leading edge of the tread projects forwardly of riser 12 or is flush (i.e., coplanar) therewith. The reason for this is to prevent the forward edge 23 from making initial contact with the front edge of a shoe sole worn by a person stepping onto tread 11 when ascending the stairway, a situation which could cause the person to trip.

The head of each screw 27 has a diameter larger than the diameter of the screw-receiving apertures 25 and is configured to be disposed entirely within recess 26 and entirely below the top surface 21 of its support substrate 20 when the screw is fully extended through the aperture. This prevents the screw from protruding above the installed traction element and interfering with a person's safety and comfort while ascending and descending a stairway on which the traction elements are installed. In a preferred embodiment, each screw 27 has a threaded shaft and a flat head joined to the shaft by a tapered neck section configured to reside in tapered recess 26 surrounding the screw-receiving aperture 25. In one specific embodiment, the screw 27 is a wood screw, 1¼ inches long (measured from the top of the head to the distal end of the threaded shaft), with a head diameter of 0.347 inch.

Figure 9:
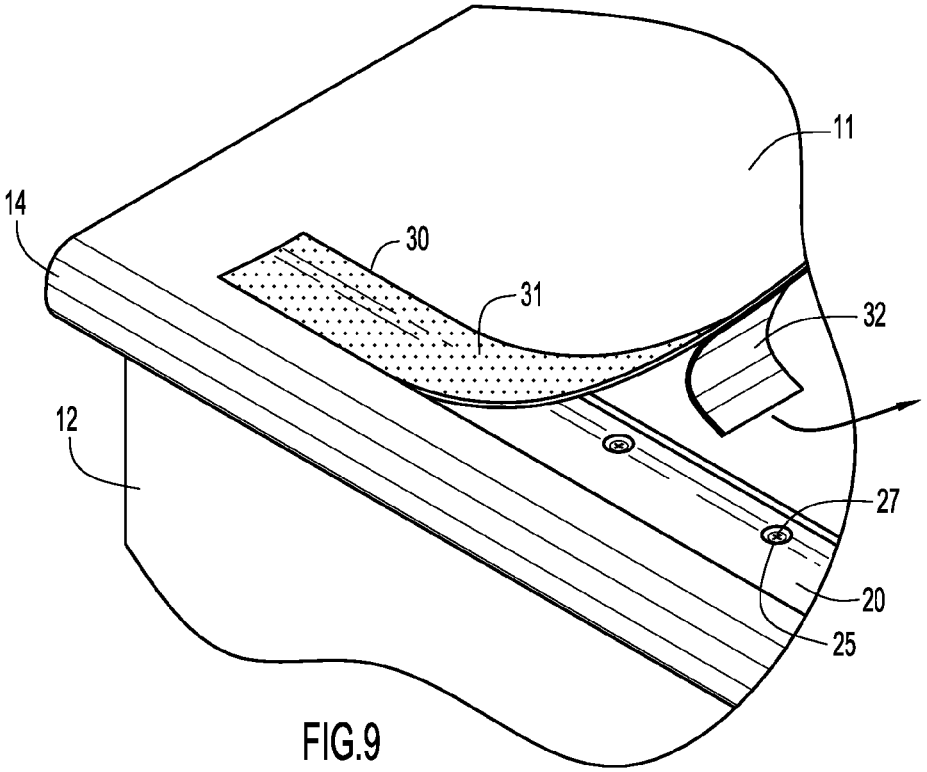
FIG. 9 is a partial view in perspective similar to FIG. 8 showing installation of the friction tape strip portion of the traction element.
Figure 10:
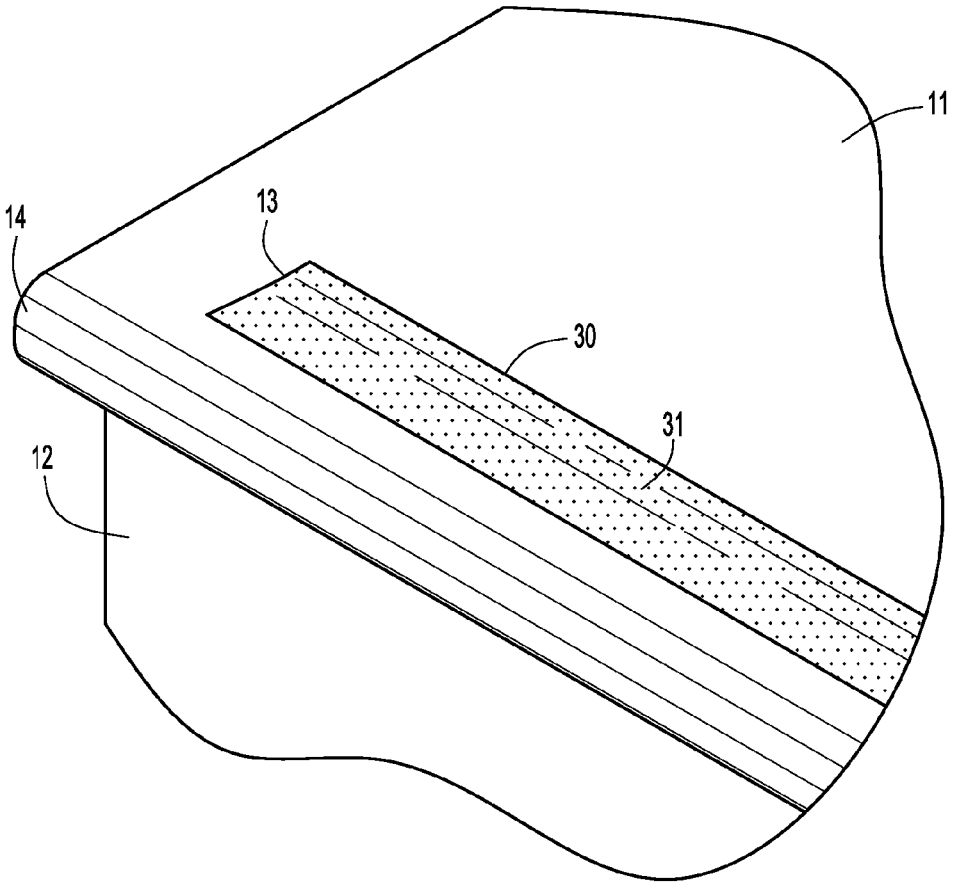
FIG. 10 is a partial view in perspective similar to FIG. 6 showing the traction element fully installed.

With the substrate 20 installed as described, a strip 30 of friction tape is applied to completely cover and conform to the top surface substrate as shown in FIGS. 9 and 10 to result in a complete traction element 13 according to the present invention. Each tape strip 30 has a bottom surface covered with an adhesive material capable of adhering the strip bottom surface to the support substrate 20. The top surface of strip 30 comprises an abrasive substance 31 (e.g., grit, paste, particles, etc.) providing much greater friction than that of substrate 20. Prior to use, the adhesive material on the bottom surface of strip 30 is covered with a peel-off protective backing strip 32 which is removed as the tape strip is placed on the substrate. The tape strip 30 is cut to substantially the same length and width dimensions as those of the substrate to which it is applied; that is, each friction tape strip 30 is configured to overlie, fully cover, conform to and have its bottom surface adhere to the top surface of a respective support substrate.

Regarding the friction effects provided by the abrasive substance on strip 30, the coefficient of friction between that substance and typical shoe soles made of leather, rubber or synthetic polymer materials such as PVC, PUR and neoprene must be substantially greater than the coefficient of friction between such shoe soles and common carpet materials such as nylon, polypropylene, acrylic, polyester, wool and cotton under wet and dry conditions. By way of example, the static coefficient of friction should be at least 0.6 and preferably as high as 1.0 or greater between the abrasive substance and rubber, leather and polymer shoe soles.

Figure 12:
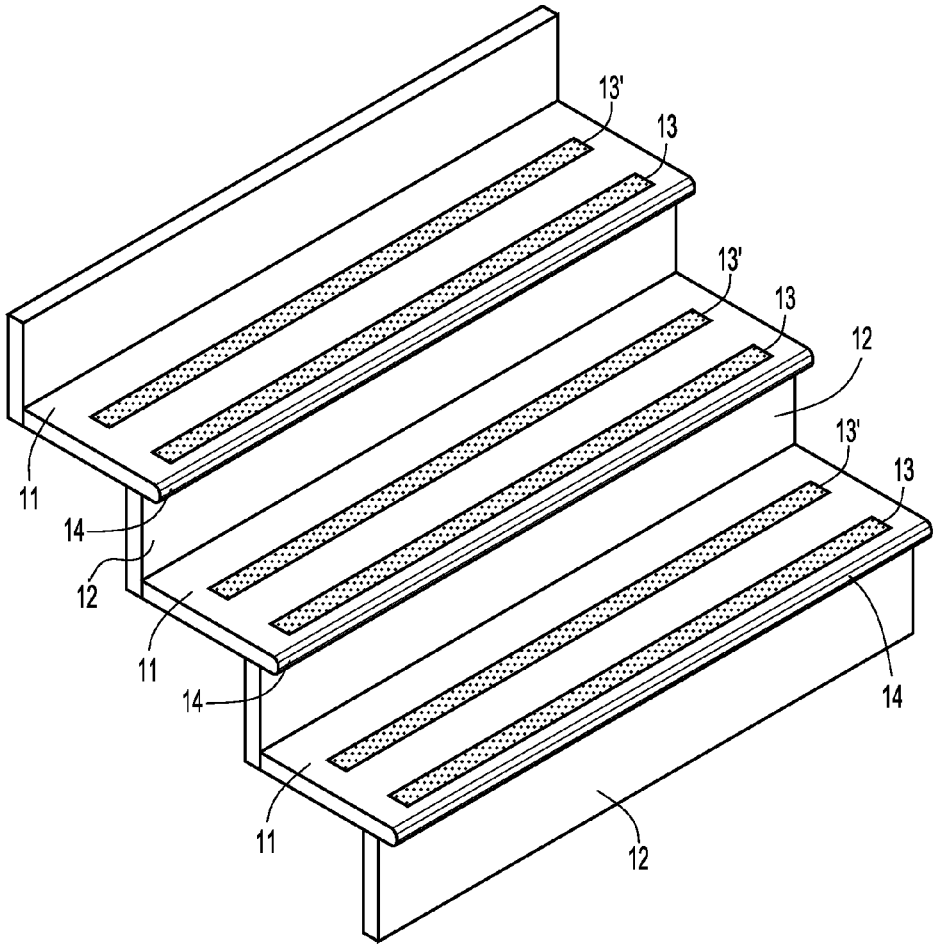
FIG. 12 is a perspective view of a carpeted stairway provided with two traction elements for each stair tread in accordance with an alternative embodiment of the present invention.

In an alternative embodiment of the invention, illustrated in FIG. 12, two traction elements 13 and 13' may be employed on each stair tread 11. Traction elements 13 and 13' are substantially identical except that element 13', being spaced rearwardly from element 13 and disposed parallel thereto, is secured only to the tread 11 and not the riser 12 which is aligned only with forward element 13.

Figure 13:
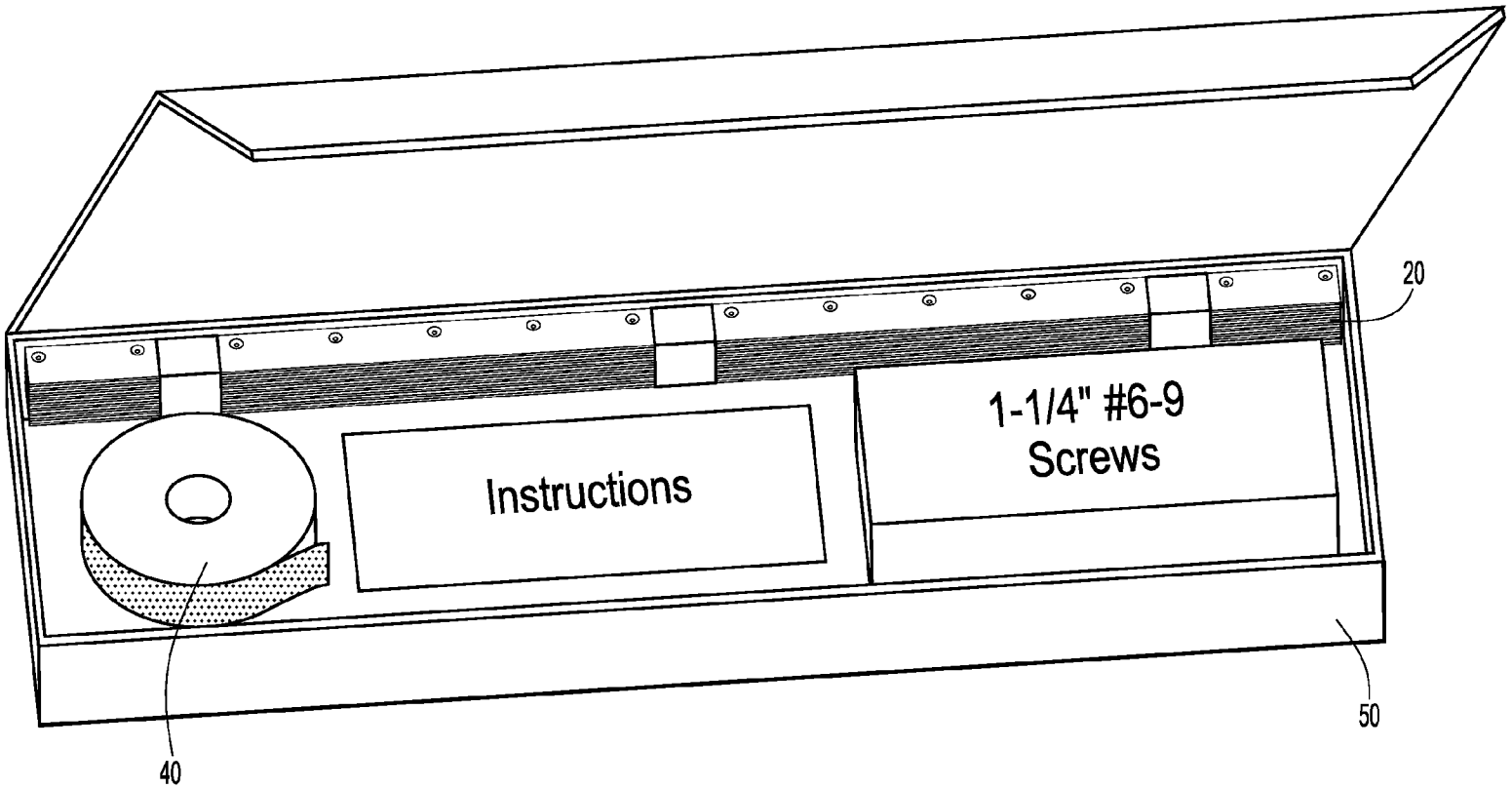
FIG. 13. is a perspective and partially diagrammatic view of a kit containing components of traction elements according to another embodiment of the present invention.
Figure 14:
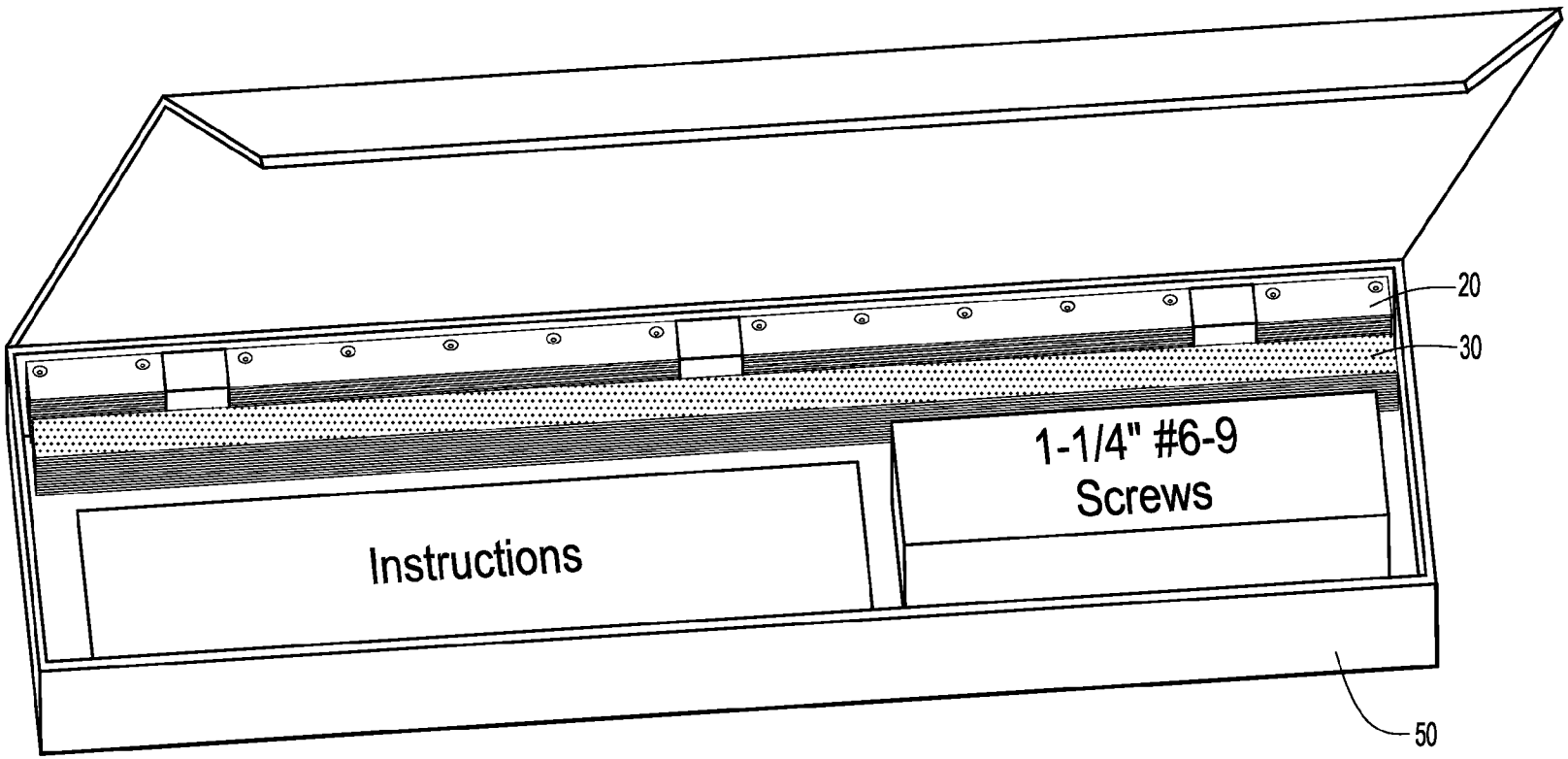
FIG. 14 is a perspective and partially diagrammatic view of an alternative kit containing components of traction elements according to another embodiment of the present invention.

In one aspect of the invention the components of traction element 13 may be sold as a kit to end users for installation on stairways and the like. In one such kit, as illustrated in FIG. 13, a box 50 or other appropriate package contains a bundle of substrates 20 suitable in number to at least match the number of treads on the purchaser's stairway. The adhesive backed friction tape is provided, in this embodiment, as a roll 40 of the tape which may be cut to individual strips by the purchaser as part of the installation. The width of the tape on the roll is substantially the same, or may be slightly greater than, the width of the substrates 20 so that each cut strip may be placed on and adhere to a respective substrate in overlying, conforming and fully covering relation. The kit may also include a sufficient number of screws to effect installation (as described above) of all the substrates in the package, and a set of installation instructions. An alternative kit is illustrated in FIG. 14 wherein the only difference from the kit of FIG. 13 is that the friction tape is provided in pre-cut strips 30 rather than in a roll.

Typically, a consumer who desires to purchase and install the traction elements of the present invention, contacts the manufacturer and provides as information the number of stairs in the stairway to receive the installation, the widths of the treads so that the manufacturer can cut the substrates 20 to proper length, and the desired color of the friction tape strip 30. The color information can be provided by either a swatch of the carpet, a color photo of the carpet, or other sample or information indicative of the desired color which may be contrasting or matching to the carpet color. The manufacturer would print a photo of the of desired color on adhesive backed waterproof vinyl, laminate the printed photo with transparent or translucent friction material, and then cut the laminated material into friction tape strips or form it into a roll to be cut by the purchaser.

In the preferred embodiments the friction tape strips are sized to match the substrate so that the substrate is fully covered. It should be further noted that a friction tape strip, once installed on the substrate, may be peeled off the substrate and replaced with another strip, either because of wear on the strip or a desire to install a strip of different color.

It should also be noted that, although the substrate 20 in the preferred embodiments has only protrusions 28 projecting from the bottom surface, a linear lip or the like may be provided to project downwardly from the bottom surface to engage underlying carpet to aid in positionally stabilizing the substrate on the carpet. In addition, sharp carpet claws may be formed by punching triangular flaps through the substrate from its top surface so that the claws can grip the underlying carpet.

The preferred embodiments disclosed herein employ traction elements 13 that are relatively narrow relative to the depth of a stair tread such that the elements overlie only a relatively small portion of a stair tread surface. It is to be understood that the elements can be made wider to cover a larger area of the tread surface. Consistent with such a wider element, although the preferred embodiments provide for a single row of screw-receiving apertures 25, it will be appreciated that additional screw-receiving apertures may be provided, not all of which would necessarily be vertically aligned with an underlying riser, but positioned to permit screws inserted therethrough to threadedly engage the tread.

As mentioned above, the traction elements 13 of the present invention, although having primary utility for preventing slippage of a person's shoe sole on carpeted stair treads, may also be used on other flooring material and not necessarily on stairs. When installed on non-stair carpeted flooring, installation of the traction elements is substantially the same as described for installation of stair treads except that the screws do not extend into any riser-like structure. When installed on hard flooring, such as wood, concrete, etc., it may be preferable to provided a recess in the flooring having perimeteric boundaries matching those of the traction element and a depth such that the top surface of the friction tape is substantially coplanar with the surrounding flooring so as to prevent persons from tripping on a raised edge of the traction element.

The lengths, widths and thicknesses of the substrate and friction tape as described herein are for particular embodiments, and it should be understood that these dimensions can be selected as desired to effect functions and procedures consistent with the principles of the invention described herein.

The principles of the invention also include eliminating the friction tape and, instead, rendering the top surface of the substrate as a high friction surface by painting high friction material thereon, scarring the surface, abrading the surface, etc. In such instances the recesses 26 and the heads of screw 27 would be covered with dots of material to avoid discomfort to person traversing the stairs.

As noted herein, although the invention has been disclosed with primary application for stairways, the principles are equally applicable for substantially any carpeted surface.

Having described preferred embodiments of new and improved method and apparatus for enhancing traction on stair treads, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation

What is claimed is:

1. A kit for assembling and installing traction elements on flooring, said kit comprising:

a plurality of elongated, planar support sheets of solid deformable metal or plastic material, and a quantity of friction tape disposed in a package;

wherein each support sheet has a top surface and a bottom surface, forward and rearward mutually parallel edges, first and second end edges, a length dimension extending between said first and second end edges, a predetermined width dimension very much smaller than said length dimension extending between said forward and rearward edges, and a thickness dimension defined between said top and bottom surfaces, said thickness dimension being sufficiently thin to provide bending deformation of said support sheet about the length dimension, wherein each support sheet includes a linear array of longitudinally spaced screw-receiving apertures of predetermined diameter defined therethrough, said linear array comprising a first screw-receiving aperture adjacent said first end edge, a second screw receiving aperture adjacent said second end edge, and multiple screw-receiving apertures spaced substantially equally along said length dimension between said first and second screw-receiving apertures, said linear array defining a longitudinal bending axis extending substantially parallel to said forward and rearward edges from said first end edge to said second end edge at a widthwise location closer to said rearward edge than to said forward edge, wherein each of said screw-receiving apertures is substantially centered in a respective concave tapered annular recess defined in said top surface and forms a convex annular protrusion extending from said bottom surface to positionally stabilize the sheet on the flooring;

wherein said friction tape has a bottom surface covered with an adhesive material capable of adhering the bottom surface of said tape to the material of said support sheets, and a top surface comprising an abrasive substance having a much higher friction than that of said support sheets, said adhesive material on said bottom surface of said friction tape being covered with a peel-off protective backing strip, said friction tape having a width dimension substantially equal to the width dimension of said support sheets, wherein the friction tape is configured to overlie, cover, conform to and have its bottom surface adhere to the top surface of said support sheets, and wherein said thickness dimension of said support sheet is in the range of 0.02 inches and 0.06 inches to provide bending deformation about said longitudinal bending axis along its entire lengthwise dimension as downward screw driving forces are applied to said support sheet.

2. The kit of claim 1, wherein said quantity of friction tape is in a roll suitable to be cut into strips configured to overlie, fully cover and have its bottom surface adhere to the top surface of a respective support sheet.

3. The kit of claim 1, wherein said quantity of friction tape is a plurality of friction tape strips equal in number to at least the number of support sheets in said plurality of support sheets, wherein each friction tape strip is configured to overlie, fully cover and have its bottom surface adhere to the top surface of a respective support sheet to provide a traction element.

4. The kit of claim 3, further comprising multiple screws equal in number to at least all of the screw-receiving apertures in said plurality of support sheets disposed in said package, each screw having a flat head diameter larger than the predetermined diameter of said screw-receiving apertures and configured to be disposed entirely below the top surface of a support sheet when that screw is extended lengthwise entirely through one of said screw-receiving apertures.

5. The kit of claim 4, wherein each of said screws has a threaded shaft and a flat head with a tapered section configured to reside in the tapered annular recess surrounding a respective screw-receiving aperture.

6. The kit of claim 3, wherein said friction tape strips have a predetermined length substantially the same as the predetermined length of said support substrates.

7. The kit of claim 6, wherein the flooring is carpet and wherein the coefficient of friction between said abrasive substance and rubber, leather and polymer shoe soles is high compared to the coefficient of friction between those shoe soles and nylon, polypropylene, acrylic, polyester, wool and cotton carpet materials under wet and dry conditions.

8. The kit of claim 7, wherein the coefficient of friction between said abrasive substance and said rubber, leather and polymer shoe soles is greater than 1.0.

9. The kit of claim 1, further comprising multiple screws equal in number to at least all of the screw-receiving apertures in said plurality of support sheets disposed in said package, each screw having a head diameter larger than the predetermined diameter of said screw-receiving apertures and configured to be disposed entirely below the top surface of a support substrate when that screw is extended lengthwise through one of said screw-receiving apertures, and wherein each of said screws has a threaded shaft and a flat head with a tapered section configured to reside in a respective screw-receiving aperture.

10. The kit of claim 1, wherein the flooring is a carpeted stair tread and wherein each support sheet is configured with said material and thickness such that when screws are fully and tightly extended through the screw-receiving apertures and threadedly engage a top edge of a stair riser with carpet material disposed between the bottom surface of the sheet and the riser, the sheet is bent about said bending axis along its entire lengthwise dimension such that its top surface is concave with a portion of the sheet forward of the bending axis slightly inclined upwardly such that the sheet forward edge is higher than the sheet rearward edge.

11. A system of traction elements for resisting slippage between a person's shoe outsole and a carpeted stairway that includes a series of horizontal carpeted stair treads interconnected by vertical risers, each stair tread having a forward tread portion secured to a top edge of one of said raisers and a rearward tread edge secured to another of said raisers, wherein said forward tread portion includes a forward tread edge, said system comprising:

a plurality of elongated, planar support sheets of solid deformable metal or plastic material, each support sheet secured to a respective stair tread at a location spaced rearwardly from the forward tread edge and directly above the top edge of said one riser, wherein each support sheet has top and bottom sheet surfaces, forward and rearward mutually parallel sheet edges, first and second sheet end edges, a sheet length dimension extending between said first and second sheet end edges, a predetermined sheet width dimension very much smaller than said sheet length dimension extending between said forward and rearward sheet edges, and a sheet thickness dimension defined between said top and bottom sheet surfaces, wherein said sheet thickness dimension is sufficiently thin to provide bending deformation of the sheet about the length dimension, wherein each support sheet includes a linear array of longitudinally spaced screw-receiving apertures of predetermined diameter defined therethrough, said linear array comprising a first screw-receiving aperture adjacent said first end edge, a second screw receiving aperture adjacent said second end edge, and multiple screw-receiving apertures spaced substantially equally along said length dimension between said first and second screw-receiving apertures, said linear array defining a longitudinal bending axis extending substantially parallel to said forward and rearward sheet edges from said first end edge to said second end edge at a location closer to said rearward sheet edge than said forward sheet edge, each screw-receiving aperture being substantially centered in a respective concave tapered annular recess defined in said top surface and forming a convex annular protrusion projecting from said bottom surface to positionally stabilize the sheet on said carpeted stair tread; and a plurality of friction tape strips, one for each support sheet, each tape strip having a strip bottom surface covered with an adhesive backing material adhering the friction tape strip bottom surface to a respective support sheet, and a strip top surface comprising an abrasive substance having a much higher coefficient of friction then that of said support sheet, said friction tape strips having a strip length dimension and a strip width dimension substantially coextensive with said sheet length dimension and said sheet width dimension, wherein each friction tape strip overlies, fully covers and conforms to the top surface of a respective support sheet;

wherein each support sheet is secured to said stair tread by a plurality of screws extending entirely through respective ones of said screw-receiving apertures into said top edge of said first one riser, compressing carpet material therebetween; and wherein the support sheet is bent about said longitudinal bending axis along its entire lengthwise dimension upon downward screw forces being applied to the concave tapered annular recesses such that said top sheet surface is concave and said forward sheet edge is higher than said rearward sheet edge to provide an upward slope in the sheet forwardly of said bending axis.

12. The system of claim 11, wherein each of said screws has a head diameter larger than the predetermined diameter of said screw-receiving apertures and is configured to be disposed entirely below the top surface of its support sheet when that screw is extended lengthwise through one of said screw-receiving apertures.

13. The system of claim 12, wherein each of said screws has a threaded shaft and a flat head with a tapered section configured to reside in tapered recess of a respective screw-receiving aperture.

14. The system of claim 11, wherein the coefficient of friction between said abrasive substance and rubber, leather and polymer shoe soles is high compared to the coefficient of friction between those shoe soles and nylon, polypropylene, acrylic, polyester, wool and cotton carpet materials under wet and dry conditions.

15. The kit of claim 14, wherein the coefficient of friction between said abrasive substance and rubber, leather and polymer shoe soles is greater than 1.0.

16. The system of claim 11, wherein said forward sheet edge is spaced rearwardly from the forward tread edge.

17. A system of traction elements for resisting slippage between a person's shoe outsole and a carpeted stairway that includes a series of horizontal carpeted stair treads interconnected by vertical risers, each stair tread having a forward tread portion secured to one of said risers and a rearward tread edge secured to another of said risers, wherein said forward tread portion includes a forward tread edge, said system comprising:

a plurality of long narrow planar support substrates of solid deformable metal or plastic material, each support substrate having top and bottom substrate surfaces, forward and rearward mutually parallel substrate edges, and first and second substrate ends, each support substrate having a substrate length dimension extending between said first and second substrate ends, a predetermined substrate width dimension very much smaller than said substrate length dimension extending between said forward and rearward substrate edges, and a thickness dimension defined between said top and bottom substrate surfaces, wherein said substrate thickness dimension is sufficiently small to provide bending deformation of the substrate about the length dimension, each support substrate having a linear array of longitudinally spaced screw-receiving apertures of predetermined diameter defined therethrough, said linear array comprising a first screw-receiving aperture adjacent said first end, a second screw receiving aperture adjacent said second end, and multiple screw-receiving apertures spaced along said length dimension between said first and second screw-receiving apertures, said linear array defining a longitudinal bending axis extending substantially parallel to said forward and rearward substrate edges from said first end to said second end at a location closer to said rearward substrate edge than said forward substrate edge, each aperture being substantially centered in a respective concave tapered annular recess defined in said top surface and forming a convex protrusion extending from said bottom surface; and a plurality of friction tape strips, one for each support substrate, each tape strip having a strip bottom surface covered with an adhesive backing material adhering the friction tape strip bottom surface to a respective support substrate, and a strip top surface comprising an abrasive substance having a much higher coefficient of friction then that of said support substrate, said friction tape strips having a strip length dimension and a strip width dimension substantially coextensive with said sheet length dimension and said sheet width dimension, wherein each friction tape strip overlies, fully covers and conforms to the top surface of a respective support substrate;

wherein each support substrate is secured to a respective stair tread such that the forward substrate edge is spaced rearwardly of the forward tread edge and the longitudinal bending axis is located directly above the top edge of said one riser; and wherein the support substrate is bent about said longitudinal bending axis from said first end to said second end upon downward screw driving forces being applied to said support substrate such that said top substrate surface is concave and said forward substrate edge is higher than said rearward substrate edge.

18. The system of claim 17, wherein each support substrate is secured to the top edge of said one riser by a plurality of screws extending entirely through respective ones of said screw-receiving apertures into said top edge and said respective stair tread and compresses carpet material located between that support substrate and said respective stair tread.

19. The system of claim 17, wherein each of said screws has a flat head with a diameter larger than the predetermined diameter of said screw-receiving apertures and is configured to be disposed entirely below the top surface of its support substrate when that screw is extended length wise through one of said screw-receiving apertures.

20. The system of claim 19, wherein the coefficient of friction between said abrasive substance and rubber, leather and polymer shoe soles is high compared to the coefficient of friction between those shoe soles and nylon, polypropylene, acrylic, polyester, wool and cotton carpet materials under wet and dry conditions.

21. The system of claim 17, wherein the thickness dimension of said substrate is in the range of 0.02 inches and 0.06 inches.

22. The system of claim 21, wherein the thickness dimension of said substrate is approximately 0.04 inches.

* * * * *